US011668072B1

(12) United States Patent
Skeie

(10) Patent No.: US 11,668,072 B1
(45) Date of Patent: Jun. 6, 2023

(54) POTENTIAL ENERGY STORAGE AND CONTROL SYSTEM FOR A HYDRAULICALLY ACTUATED ELEMENT

(71) Applicant: Brandt Industries Canada Ltd., Regina (CA)

(72) Inventor: Alexander Skeie, Regina (CA)

(73) Assignee: Bourgault Industries Ltd., St. Brieux (CA)

( * ) Notice: Subject to any disclaimer, the term of this patent is extended or adjusted under 35 U.S.C. 154(b) by 0 days.

(21) Appl. No.: 17/974,110

(22) Filed: Oct. 26, 2022

(51) Int. Cl.

| | |
|---|---|
| ***E02F 9/22*** | (2006.01) |
| ***F15B 21/14*** | (2006.01) |
| ***F15B 1/027*** | (2006.01) |
| ***F15B 1/02*** | (2006.01) |

(52) U.S. Cl.
CPC ..... *E02F 9/2217* (2013.01); *E02F 9/2228* (2013.01); *F15B 1/024* (2013.01); *F15B 1/027* (2013.01); *F15B 21/14* (2013.01)

(58) Field of Classification Search
CPC ..... F15B 1/024; F15B 1/027; F15B 21/14; E02F 9/2217
See application file for complete search history.

(56) References Cited

U.S. PATENT DOCUMENTS 6,918,247 B1 * 7/2005 Warner ..... F15B 21/14 60/414
7,434,391 B2 * 10/2008 Asam ..... F15B 1/024 60/414
7,819,195 B2 * 10/2010 Ellis ..... E21B 19/006 166/355
8,418,451 B2 * 4/2013 Stanger ..... E02F 9/2271 60/414
8,938,956 B2 * 1/2015 Asam ..... E02F 9/2296 60/329
9,151,018 B2 * 10/2015 Knussman ..... E02F 9/2289
9,163,385 B2 * 10/2015 Lavergne ..... F16F 9/0236
(Continued)

FOREIGN PATENT DOCUMENTS

WO WO 2015/022054 2/2015
WO WO-2018202419 A1 * 11/2018 ..... F15B 1/027
WO WO 2010/049594 5/2020

OTHER PUBLICATIONS

U.S. Appl. No. 17/974,003 entitled Hydraulic Circuit and Method for a Material Handler, filed Oct. 26, 2022.

*Primary Examiner* — Michael Leslie
(74) *Attorney, Agent, or Firm* — Nicole M. Tepe

(57) ABSTRACT

A system and method for storing potential energy for a material handler. The system and method involves actuating a machine element using hydraulic cylinders; measuring a position of the machine element; controlling the hydraulic cylinders with a hydraulic circuit by an electronic control unit; determining a maximum target pressure for at least one gas actuator coupled to the machine element; calculating a target pressure for the at least one gas actuator at the position; measuring a gas pressure measurement from the at least one gas actuator; comparing the target pressure to the gas pressure measurement; and adjusting a hydraulic adjustment valve to increase or decrease an amount of hydraulic fluid within a hydraulic chamber of an accumulator thereby changing a gas pressure within the at least one gas actuator to correspond to the target pressure.

20 Claims, 6 Drawing Sheets

(56) References Cited

U.S. PATENT DOCUMENTS

| | | | | |
|---|---|---|---|---|
| 9,638,217 | B2 * | 5/2017 | Yang | B66C 13/20 |
| 9,791,015 | B2 * | 10/2017 | Kloft | E02F 9/2217 |
| 11,268,263 | B2 * | 3/2022 | Wagner | E02F 3/425 |

* cited by examiner

POTENTIAL ENERGY STORAGE AND CONTROL SYSTEM FOR A HYDRAULICALLY ACTUATED ELEMENT

FIELD

This invention is in the field of potential energy storage and in particular to potential energy storage used in a material handler.

BACKGROUND

U.S. Pat. No. 8,938,956 to Liebherr discloses an implement, in particular an excavator or machine for material handling, with an element movable via at least one working drive, wherein at least one energy recovery cylinder is provided for energy recovery from the movement of the movable element, which includes a chamber filled with gas, wherein the actuation of the implement is effected in dependence on the directly or indirectly determined temperature of the gas in the chamber filled with gas.

World Intellectual Property Organization Pub. No. WO2010049594 to GROHN discloses a method and an arrangement for storing energy, such as potential energy, and for using the stored energy in a fluid system, such as a hydraulic or pneumatic system, which fluid system comprises a fluid cylinder, such as a hydraulic or pneumatic cylinder, consisting of a cylinder and a piston arrangement movably mounted in the cylinder, and actuators for moving the fluid cylinder's piston arrangement in the cylinder.

World Intellectual Property Office Pub. No. WO2015022054 to Bauer et al. discloses a system for the automatic adaptation of a predefinable gas input quantity in a working system with system components which can be moved relative to one another, in which the pressure of the gas input quantity can be changed during operation by way of compression or expansion and/or in the case of changing operating and ambient temperatures, wherein an accumulator system with a predefinable accumulator volume can be connected via a control device to the working system in such a way that, in the case of a compression within the working system, part of the gas input quantity can be output as accumulator quantity to the accumulator system and in the case of an expansion within the working system, can be fed to the working system again as a gas input quantity in a manner which can be recalled from the accumulator system, serves, in particular, for equalizing changes in the temperature in the working system and/or in the surroundings thereof.

SUMMARY

There is provided a potential energy storage system for a material handler having a machine element; a position sensor measuring a position of the machine element; one or more hydraulic cylinders to actuate the machine element; a hydraulic circuit hydraulically coupled to the hydraulic cylinders to control motion of the hydraulic cylinders; one or more compressible gas actuators to actuate the machine element; an accumulator comprising a hydraulic chamber and a gas chamber coupled to the compressible gas actuators; a hydraulic adjustment valve providing a hydraulic fluid to the hydraulic chamber of the accumulator; a pressure sensor measuring a gas pressure within the gas chamber; and an electronic control unit (ECU) executing instructions from a tangible computer-readable medium. The ECU may determine a maximum target pressure for the gas actuator; receive the position; calculate a target pressure at the position; receive a gas pressure measurement from the pressure sensor; compare the target pressure to the gas pressure measurement; and adjusting the hydraulic adjustment valve to adjust the gas pressure measurement to correspond to the target pressure.

According to an aspect, the electronic control unit may calculate a gas volume in the at least one compressible gas actuator at the position; and calculates the target pressure based on the gas volume and the maximum target pressure. The electronic control unit may calculate a pin-to-pin distance for the at least one compressible gas actuator to calculate the gas volume.

The position sensor may be an encoder measuring a current angle between the machine element and a platform.

The electronic control unit may perform an adjustment of the hydraulic adjustment valve to add hydraulic fluid to the accumulator or remove hydraulic fluid from the accumulator in 3-second increments. The electronic control unit may disable the adjustment of the hydraulic adjustment valve for 5-minutes following the adjustment.

According to another aspect, the potential energy storage system may further comprise a tail end pressure sensor and a rod end pressure sensor measuring a tail pressure and a rod pressure respectively from the at least one hydraulic cylinder. The electronic control unit may receive an average target pressure; calculate an average tail pressure when the hydraulic cylinders are extending; and calculate an average rod pressure when the hydraulic cylinders are retracting. The electronic control unit may compare the average tail pressure to the average target pressure; compare the average rod pressure to the average target pressure; and determine when the maximum target gas pressure should increase, decrease, or be constant. The average tail pressure and the average rod pressure may be calculated over a period of 5 minutes.

According to yet another aspect, there is provided a computer-implemented method for storing potential energy for a material handler. The method may actuate a machine element using at least one hydraulic cylinder; measure a position of the machine element; control the at least one hydraulic cylinder with a hydraulic circuit by an electronic control unit; determine a maximum target pressure for at least one gas actuator coupled to the machine element; calculate a target pressure for the at least one gas actuator at the position; measure a gas pressure measurement from the at least one gas actuator; compare the target pressure to the gas pressure measurement; and adjust a hydraulic adjustment valve to increase or decrease an amount of hydraulic fluid within a hydraulic chamber of an accumulator thereby changing a gas pressure within the at least one gas actuator to correspond to the target pressure.

The computer-implemented method may further calculate a gas volume in the at least one compressible gas actuator at the position; and calculating the target pressure based on the gas volume and the maximum target pressure. The computer-implemented method may calculate a pin-to-pin distance for the at least one compressible gas actuator to calculate the gas volume. The position sensor may be an encoder measuring a current angle between the machine element and a platform.

The computer-implemented method may further comprise adding the amount of hydraulic fluid to the accumulator or removing the amount of hydraulic fluid from the accumulator in 3-second increments. The computer-implemented method may further comprise waiting for 5-minutes following the adjusting step.

According to another aspect, the computer-implemented method may further comprise: measuring a tail pressure with a tail end pressure sensor from the at least one hydraulic cylinder; and measuring a rod pressure from a rod end pressure sensor from the at least one hydraulic cylinder. The computer-implemented method may further comprise: receiving an average target pressure; calculating an average tail pressure when the at least one hydraulic cylinder is extending; and calculating an average rod pressure when the at least one hydraulic cylinder is retracting. The computer-implemented method may further comprise: comparing the average tail pressure to the average target pressure; comparing the average rod pressure to the average target pressure; and determining when the maximum target gas pressure should increase, decrease, or be constant. The computer-implemented method may further comprises: calculating the average tail pressure and the average rod pressure over a period of 5 minutes.

DESCRIPTION OF THE DRAWINGS

While the invention is claimed in the concluding portions hereof, example embodiments are provided in the accompanying detailed description which may be best understood in conjunction with the accompanying diagrams where like parts in each of the several diagrams are labeled with like numbers, and where:

DETAILED DESCRIPTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1A:
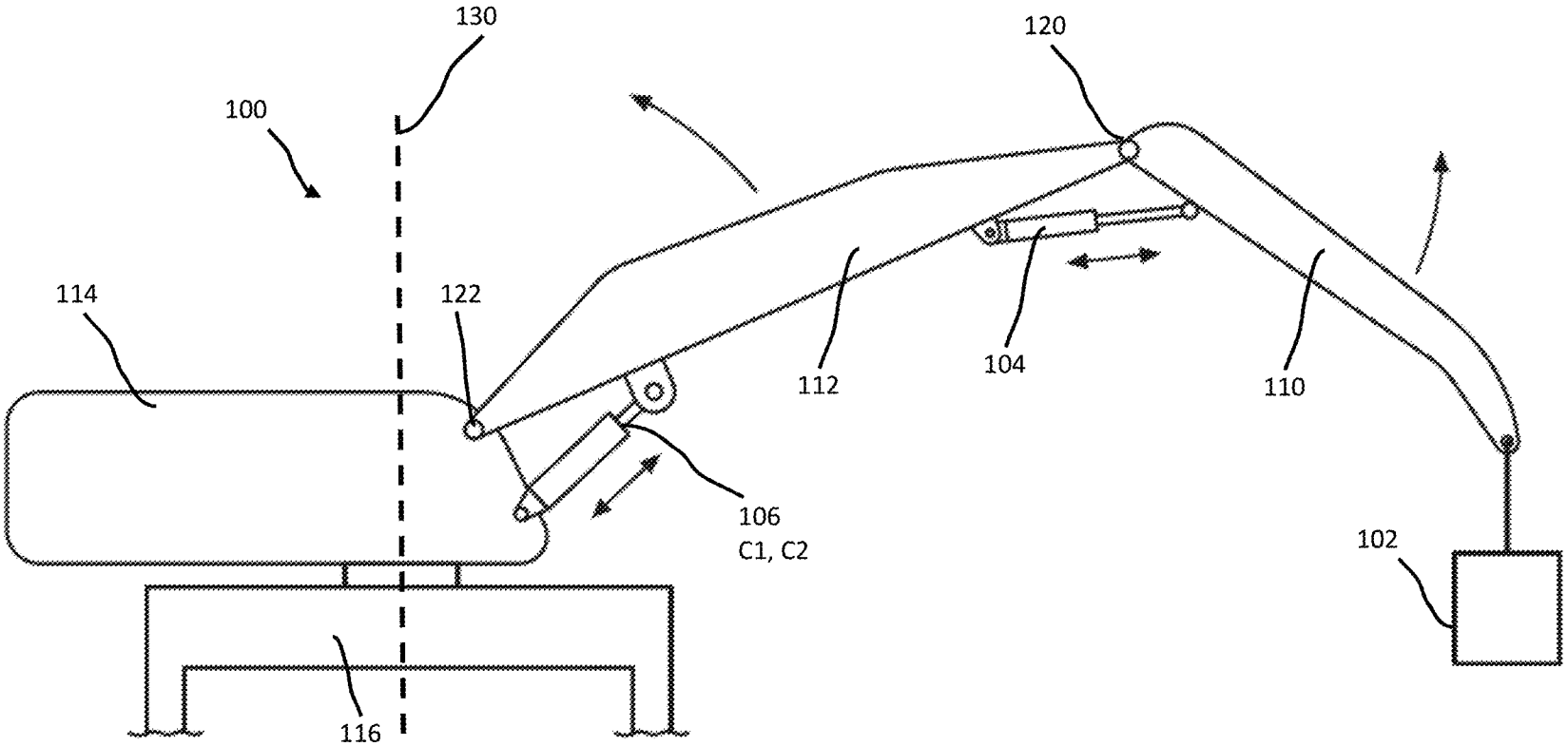
FIG. 1A is a side view of a material handler with an arm fully extended.

Turning to FIGS. 1A and 1*i*, a material handler 100 may comprise an arm having an upper linkage 110 pivotally coupled to a lower linkage 112. In some aspects, the material handler 100 may be a converted excavator, such as by using a modular hydraulic thumb (not shown) as described in U.S. application Ser. No. 17/507,013, the content of which is explicitly incorporated by reference in its entirety. The upper linkage or stick 110 may be extended or retracted with respect to the lower linkage or boom 112 at a pivot 120 using an arm hydraulic cylinder 104. The boom 112 may be pivotally coupled to a rotatable platform 114, which may comprise a cab for a vehicle operator. Likewise, the boom 112 may be extended or retracted with respect to the rotatable base 114 at pivot 122 using a boom hydraulic cylinder 106. The rotatable platform 114 may rotate the entire arm about a vertical axis 130 shown particularly in FIG. 1A. The rotatable platform 114 may be coupled to a support platform 116, which may be mobile or fixed.

The material handler 100 may generally have a longer reach, when compared to the excavator, as shown in FIG. 1A and/or may need more stability during use. Particularly, optimizing a fuel consumption of the material handler 100 may be advantageous. When raising the boom 112, the boom cylinders 106 may be under very high pressure that uses a larger quantity of fuel. For example, the fuel consumption may be approximately 22 L/hour and after using one or more of the techniques described herein, the fuel consumption may be approximately 17 L/hour. In order to minimize or reduce fuel usage, an energy storage system and method may be provided herein. Although the aspects described herein describe the boom 112 and the boom cylinders 106, other aspects may apply the aspects herein to the stick 110 and the stick cylinders 104.

Figure 2:
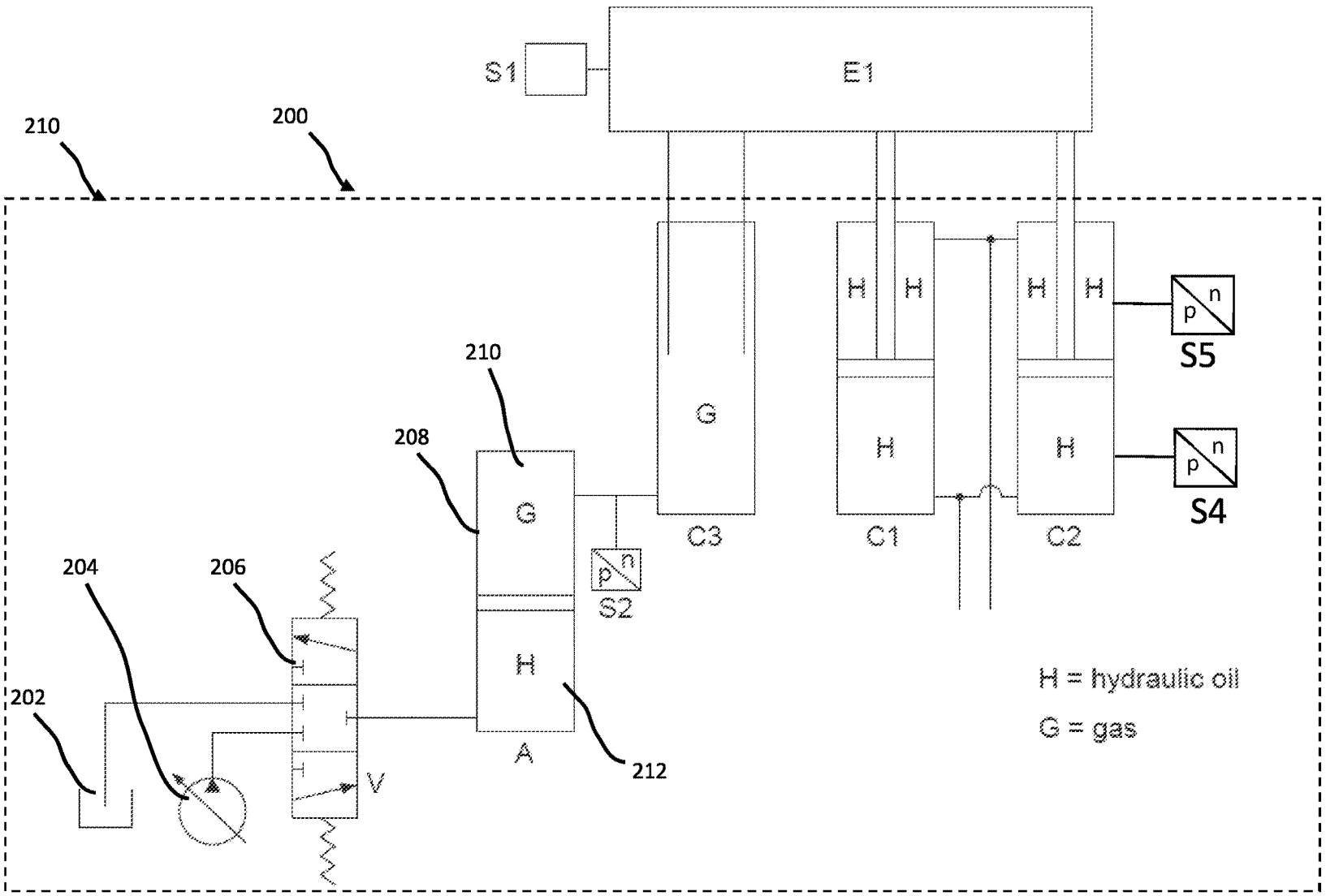
FIG. 2 is a block diagram of a potential energy storage system.

Turning to FIG. 2, a potential energy storage system 200 may comprise a machine element E1 actuated by an element control system 210. The machine element E1 may be a boom 112, an arm 110, an attachment (such as modular hydraulic thumb), a load 102, other similar type of machine element E1, and/or a combination thereof.

The element control system 210 may comprise one or more hydraulic actuators C1, C2, which in this aspect may be the boom hydraulic cylinders 106 (or actuator) and/or the arm hydraulic cylinders 104. Each of the hydraulic cylinders C1, C2 may be coupled to and actuate the machine element E1 to move the machine element E1. Each of the hydraulic cylinders C1, C2 may be controlled via a hydraulic circuit and electronic control unit (ECU), such as described in U.S. application Ser. No. 17/974,003, filed on the same date as the present application by the same applicant and herein explicitly incorporated by reference in its entirety. The element control system 210 may also comprise one or more compressible gas actuators C3 also coupled to and acting on the machine element E1. The compressible gas actuators C3 may be connected to an accumulator 208, which may have a gas chamber 210 coupled to the gas actuator C3 and a hydraulic chamber 212 coupled to a hydraulic adjustment valve 206. In this aspect, the gas within the gas actuator C3 and the gas accumulator 208 is nitrogen, although other gases may be used. The hydraulic adjustment valve 206 may change a volume of oil in the accumulator 208 provided by a pump 204 and received by a tank 202. The change in volume of oil may achieve a desired gas pressure 302 within the gas chamber 210 as measured by a pressure sensor S2 in order to generate a resultant force by the gas actuator C3 on the machine element E1.

The stored gas in the gas cylinder C3, such as a nitrogen cylinder, may remove or reduce the load 102 from the boom cylinders 106. In one aspect, one or more sensors S1 can be used to measure the volume of the stored gas and may be measured with the accumulator 208 in order to precisely adjust the volume of the stored gas. In another aspect, one or more feedback sensors S2 may be used to determine a pressure of the stored gas to achieve an equivalent force generally corresponding to an operator setting for how much force assistance from gas cylinder C3 should provide to minimize the load on cylinders C1 and C2. The gas cylinder C3 and the accumulator 208 may stores potential energy as the hydraulic cylinder C1, C2 move the machine element E1.

Figure 3:
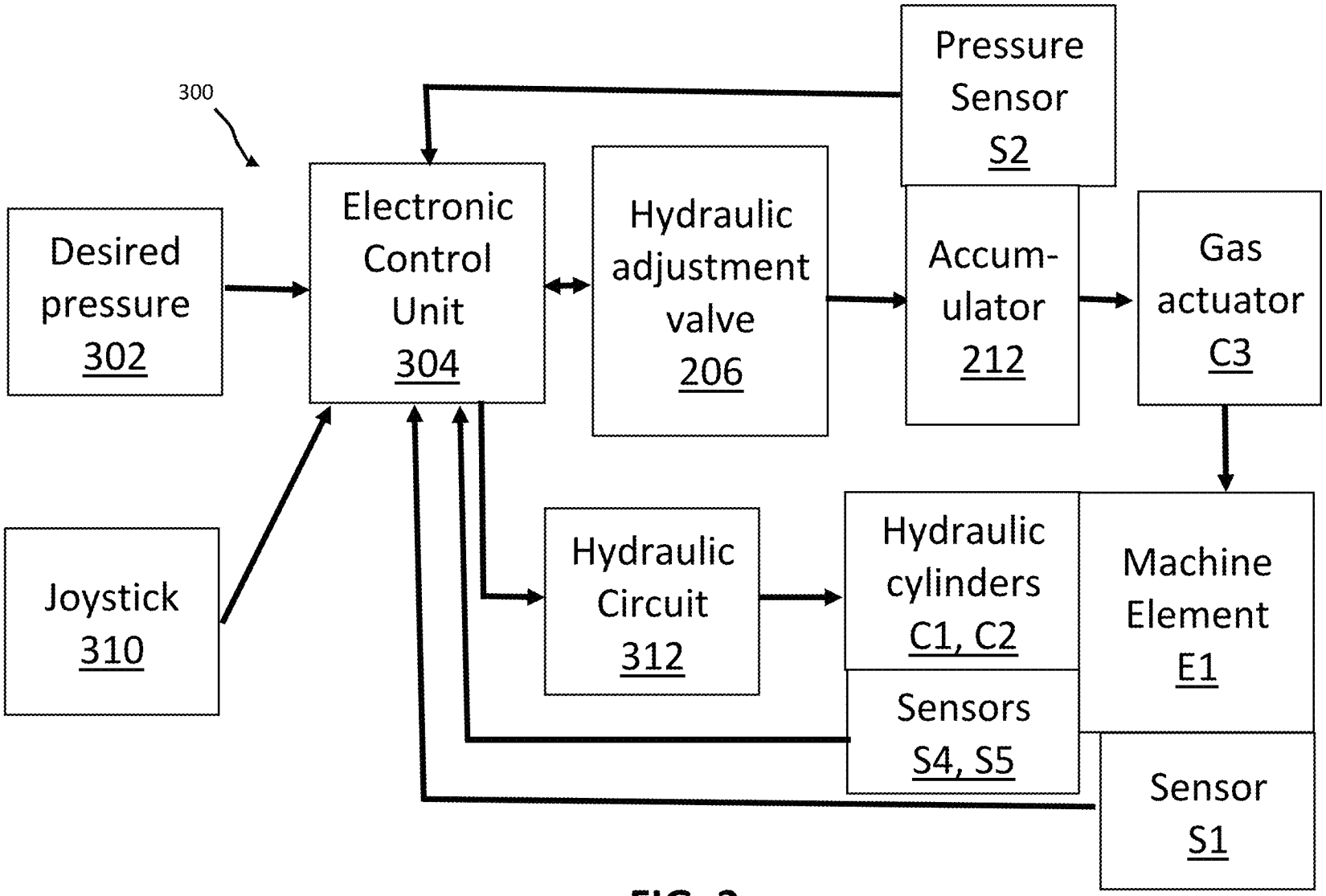
FIG. 3 is a block diagram of a control system for the potential energy storage system.

Turning to FIG. 3, an electronic control unit (ECU) 304 may receive joystick signals from one or more joysticks 310. In turn, the ECU 304 may process these joystick signals in order to provide instructions to a hydraulic circuit 312 in order to control the hydraulic cylinders C1, C2. A control system 300 may comprise the ECU 304 receiving the desired or setpoint pressure 302 for the gas actuator C3. The ECU 304 may receive one or more pressure measurements from the pressure sensor S2 and/or one or more measurements from a machine element sensor S1. The machine element sensor S1 may comprise a position sensor, such as one or more encoders, on the machine element E1, such as on the boom 112 or arm 110, and/or a load sensor between the load 102 and the arm 110. The machine element sensor S1 may measure a lifted weight, an overhang distance (e.g. a lateral distance from a center of the load 102 to a center of the support platform 116), and/or a resultant total load on the element control system 210. The tail end pressure sensor S4 measures the pressure at the tail end of the hydraulic boom cylinder C2, and the rod end pressure sensor S5 measures the pressure at the rod end of the hydraulic boom cylinder C2. The overhang distance may be calculated by the ECU 304 based on a known geometry of the machine element E1 based at least on encoder measurements from the joints 120, 122. The ECU 304 may adjust the gas pressure and/or volume in the gas actuator C3 via the accumulator 208 by sending control signals to the hydraulic adjustment valve 206 in order to optimize the equivalent force for the load force. In some aspects, the ECU 304 may automatically adjust for changes in temperature without using a temperature sensor by adjusting the hydraulic fluid in the accumulator p208 to approach a target gas pressure.

Figure 4:
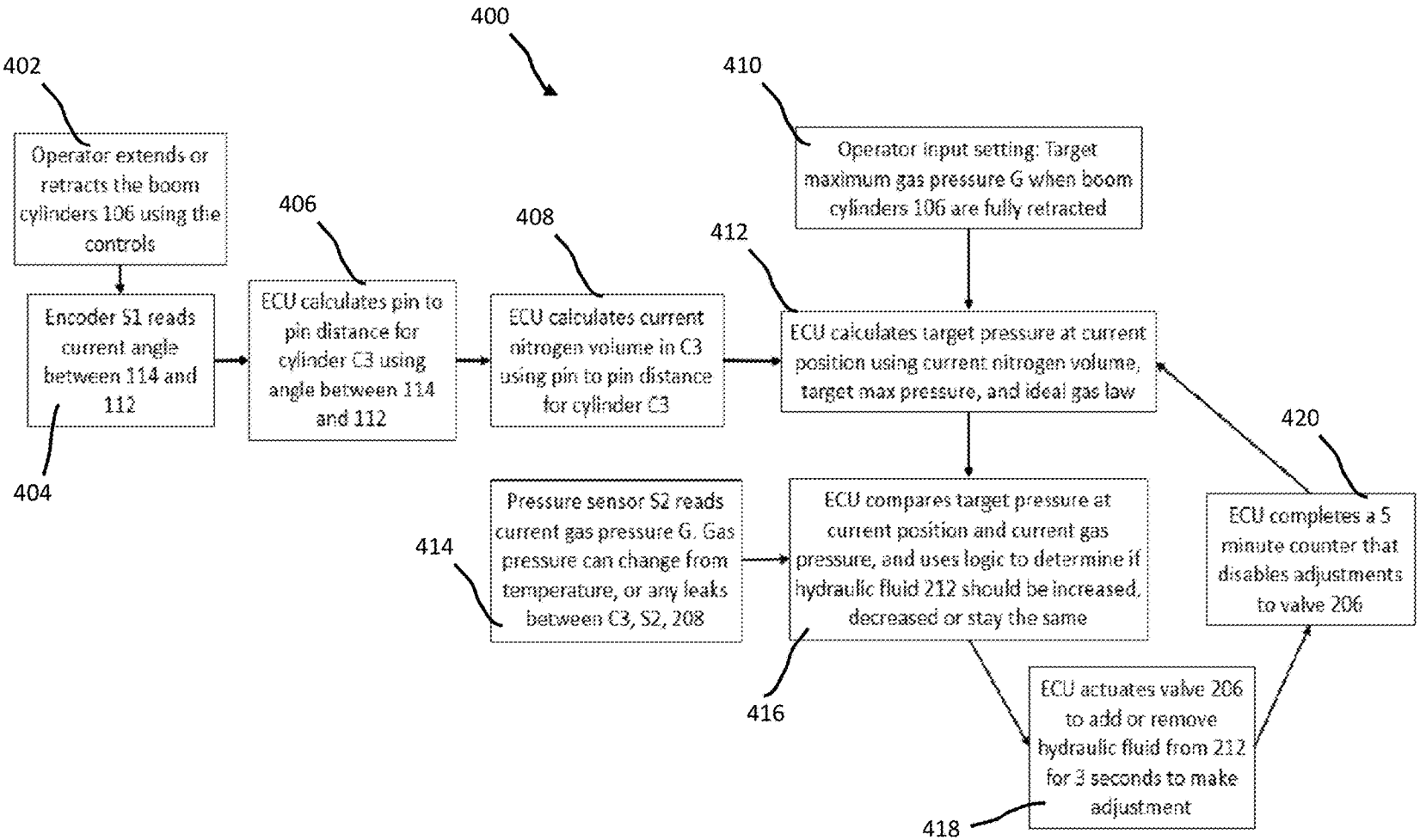
FIG. 4 is a process flow diagram for a control system that uses an input target gas pressure.

Turning to FIG. 4, a process for storing the potential energy 400 is presented. An operator may extend and/or retract the boom cylinders 106 using the joysticks 310 at step 402. The operator may also provide a maximum target gas pressure G when the boom cylinders 106 are in a fully retracted position at step 410. One or more encoders S1 may read a current angle between the rotatable platform 114 and the boom 112 at step 404. In particular, the current angle may be measured by the encoder S1 at the pivot(s) 122, 120. The ECU 304 may calculate a pin-to-pin distance for the gas cylinder C3 using the current angle measurement at step 406. The ECU 304 may calculate a current gas volume in the gas cylinder C3 using the pin distance for the gas cylinder C3 at step 408. At step 412, the ECU 304 may calculate a target pressure at the current position using the current gas volume, the maximum target pressure, and the ideal gas law (e.g. PV=nRT).

The ECU 304 receives a current gas pressure G from the pressure sensor S2 at step 414. The ECU 304 may then compare the target pressure at the current position and the current gas pressure to the pressure sensor measurement to determine when the hydraulic fluid in the hydraulic chamber 212 should be increased, decreased, or stay constant at step 416. The ECU 304 may then actuate the hydraulic adjustment valve 206 to add hydraulic fluid 212 to the accumulator 208 or remove hydraulic fluid 212 from the accumulator 208 in 3-second time increments at step 418. The ECU 304 may then wait approximately 5-minutes at step 420 before returning to step 412. The process 400 may enable the operator to adjust the target gas pressure G according to operational requirements.

In one example, the operator may have to move material as far as possible, such as picking up the load 102 in an extended position, such as shown in FIG. 1A, swing around 180-degrees about platform 116, and dropping the load 102. The material handler 100 may be more (or most) efficient when with the target gas pressure G is at or near a maximum target gas pressure because the hydraulic cylinders 106 are always under high pressure in the extended position. The operator may increase the target gas pressure G thereby adding more hydraulic fluid 212 to the accumulator 208 and thereby increasing the gas pressure within the gas cylinder C3.

Figure 1B:
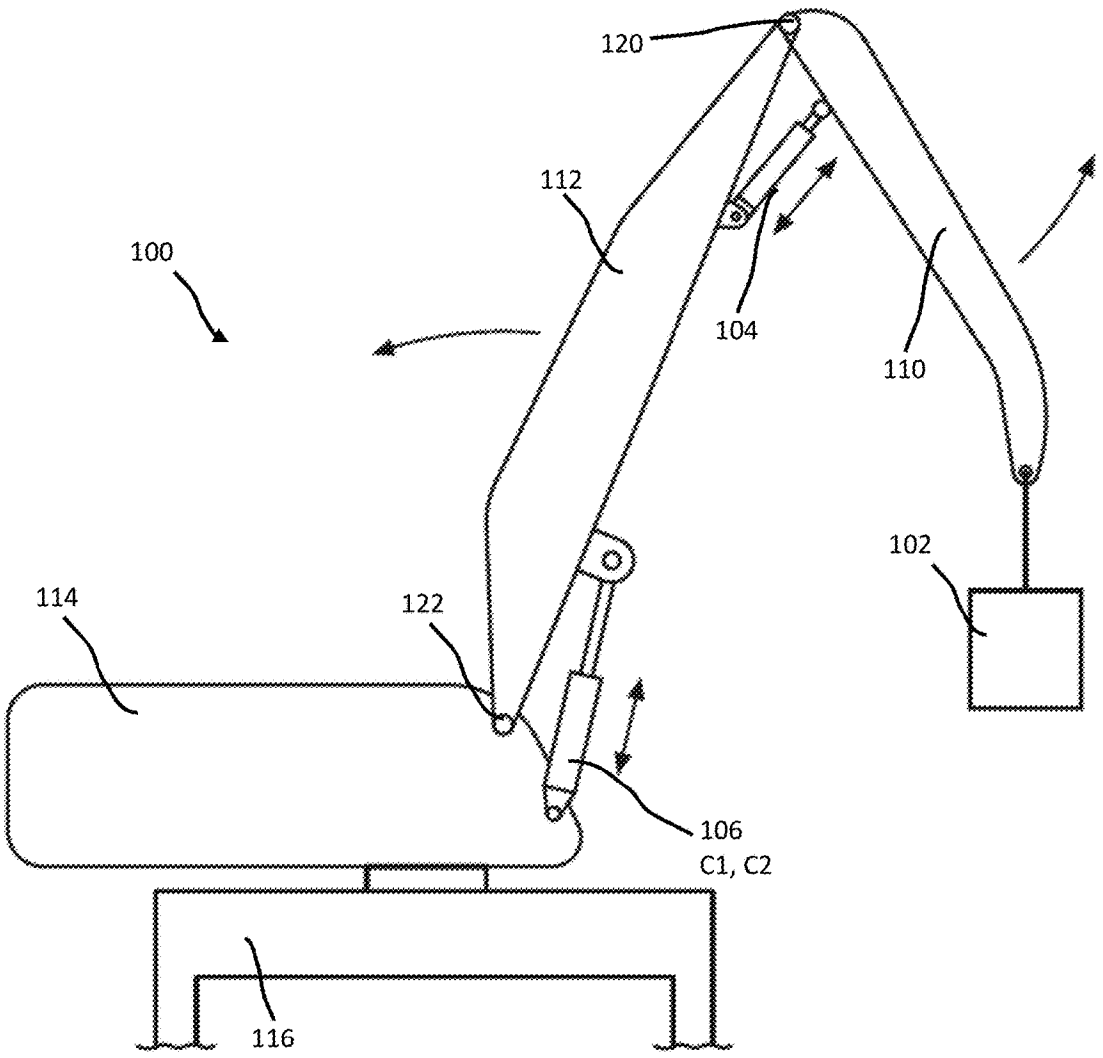
FIG. 1B is a side view of the material handler with the arm retracted.

In another example, the operator may have to lower the load 102 onto a pile of loose material within a container (not shown). The material handler 100 may have to retract the cylinder 106 and may use an attachment (not shown) on the upper linkage 110 to press the load 102 as much as possible in order to put more material into the container. The material handler 100 may be in a retracted position, such as shown in FIG. 1B, so the operator can see within the container where the attachment is applying a downward force. When the target gas pressure G is too high, more hydraulic pressure may be necessary to create the downward force as the hydraulic cylinders 106 may be acting against the gas cylinder C3. In such an instance, the material handler 100 may be more efficient when the target gas pressure G is reduced by the operator thereby reducing the hydraulic fluid 212 in the accumulator 208 and thereby reducing the gas pressure within the gas cylinder C3.

In some aspects, the material handler 100 may need to perform variations of these two examples throughout the day and therefore, the adjustment of the target gas pressure G may result in improved efficiency of the material handler 100 based on the operational scenarios.

One more note on the gas pressure required: the system naturally adjusts for the changing requirements of pressure between FIGS. 1A and 1B without adding or removing fluid from 212 at all because of the change in volume when extending or retracting cylinder C3, and the ideal gas law.

Figure 5:
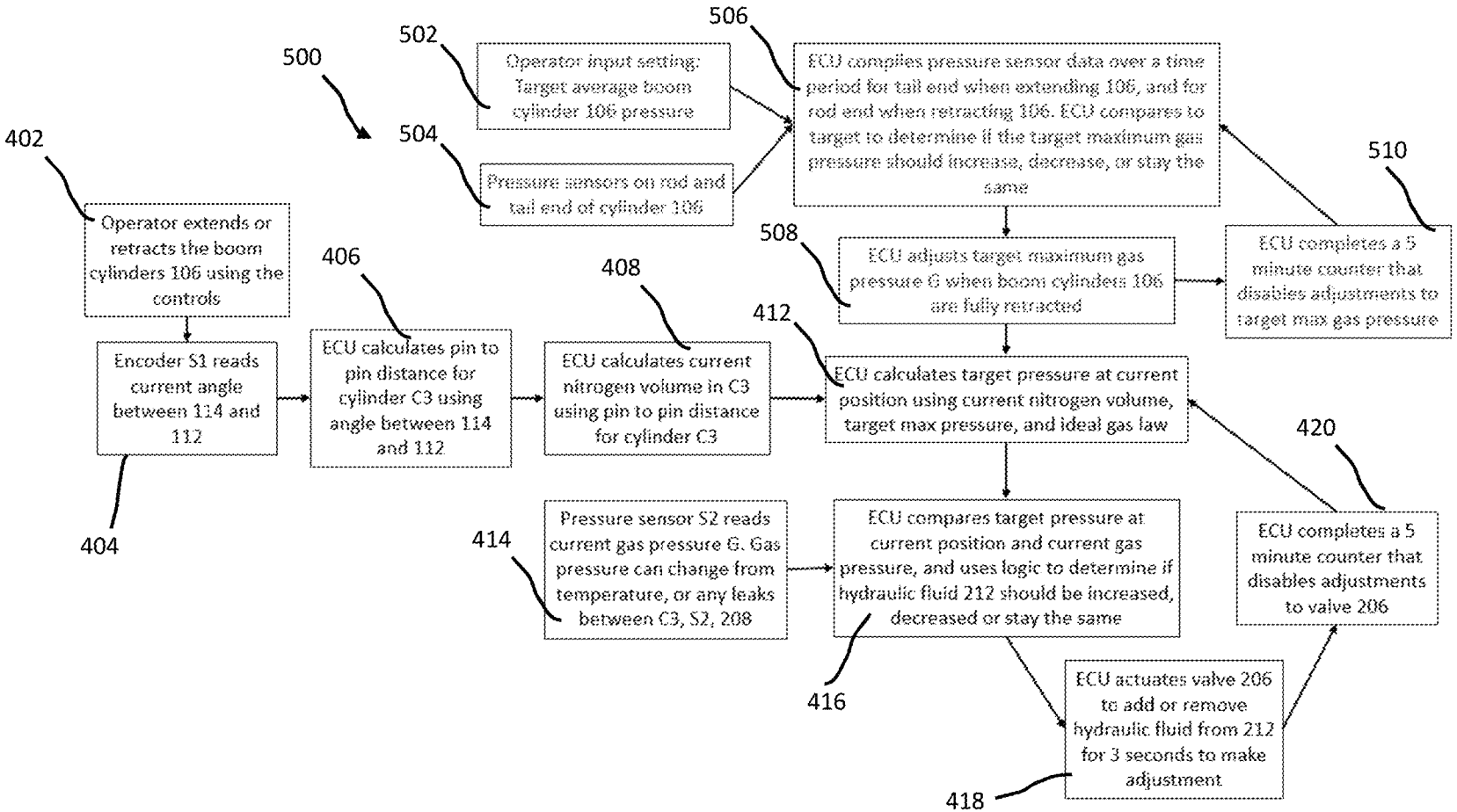
FIG. 5 is a process flow diagram for a control system that uses an input target boom cylinder pressure.

Turning to FIG. 5, another process for storing the potential energy 500 is presented. As a number of steps are similar to the process described with reference to FIG. 4, the same numbering is provided. An operator may extend and/or retract the boom cylinders 106 using the joysticks 310 at step 402. One or more encoders S1 may read a current angle between the rotatable platform 114 and the boom 112 at step 404. In particular, the current angle may be measured by the encoder S1 at the pivot(s) 122, 120. The ECU 304 may calculate a pin-to-pin distance for the gas cylinder C3 using the current angle measurement at step 406. The ECU 304 may calculate a current gas volume in the gas cylinder C3 using the pin distance for the gas cylinder C3 at step 408.

In comparison with the process 400, step 410 where the operator may provide a maximum target gas pressure G when the boom cylinders 106 are in a fully retracted position may be replaced with steps 502-510 in the process 500. The operator may set an average target pressure for the boom cylinders 106 at step 502. One or more pressure sensors S4, S5 on a rod end and a tail end of the cylinders 106 may provide pressure measurements within the cylinders 106 to the ECU 304 at step 504. The ECU 304 may compile the pressure sensor measurements over a time period for the pressure sensor S4 when the cylinders 106 are extending and the pressure sensor S5 when the cylinders 106 are retracting at step 506.

The ECU 304 may compare the pressure sensor measurements to the average target pressure to determine when the maximum target gas pressure should increase, decrease, or be constant. When the current boom cylinder tail pressure averaged over the last 5 minutes for all instances when cylinder 106 is extended, the maximum target gas pressure would increase. When the current boom cylinder rod pressure averaged over the last 5 minutes when the cylinder 106 is retracted, the maximum target gas pressure G would decrease. In this manner, the operator may not have to manually adjust the maximum target gas pressure G, the process 500 may determine current pressures for the boom cylinders 106 that are outside of the target range and adjust automatically.

The ECU 304 may adjust the target gas pressure G when the boom cylinders 106 are fully retracted at step 508. This target gas pressure G may be used in step 412 where the ECU 304 may calculate a target pressure at the current position using the current gas volume, the target pressure, and the ideal gas law (e.g. PV=nRT). The ECU 304 may wait for approximately 5-minutes at step 510 before returning to step 506. This waiting period may be adjusted using a counter.

The ECU 304 receives a current gas pressure G from the pressure sensor S2 at step 414. The ECU 304 may then compare the target pressure at the current position and the current gas pressure to the pressure sensor measurement to determine when the hydraulic fluid 212 in the accumulator 208 should be increased, decreased, or stay constant at step 416. The ECU 304 may then actuate the hydraulic adjustment valve 206 to add hydraulic fluid 212 to the accumulator 208 or remove hydraulic fluid 212 from the accumulator 208 in 3-second time increments at step 418. The ECU 304 may then wait approximately 5-minutes at step 420 using a counter before returning to step 412. The process 400 may enable the operator to adjust the target gas pressure G according to operational requirements.

Although the aspects described herein demonstrate an arm with two linkages 110, 112 with two hydraulic cylinders 104, 106, other aspects may have more linkages and hydraulic cylinders.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A potential energy storage system for a material handler comprising:

a machine element;

a position sensor measuring a position of the machine element;

at least one hydraulic cylinder to actuate the machine element;

a hydraulic circuit hydraulically coupled to the at least one hydraulic cylinder to control motion of the at least one hydraulic cylinder;

at least one compressible gas actuator to actuate the machine element;

an accumulator comprising a hydraulic chamber and a gas chamber coupled to the at least one compressible gas actuator;

a hydraulic adjustment valve providing a hydraulic fluid to the hydraulic chamber of the accumulator;

a pressure sensor measuring a gas pressure within the gas chamber;

an electronic control unit executing instructions from a tangible computer-readable medium to:

determine a maximum target pressure for the gas actuator;

receive the position;

calculate a target pressure at the position;

receive a gas pressure measurement from the pressure sensor;

compare the target pressure to the gas pressure measurement; and adjusting the hydraulic adjustment valve to adjust the gas pressure measurement to correspond to the target pressure.

2. The potential energy storage system according to claim 1, wherein the electronic control unit further executes instructions to: calculate a gas volume in the at least one compressible gas actuator at the position; and calculates the target pressure based on the gas volume and the maximum target pressure.

3. The potential energy storage system according to claim 2, wherein the electronic control unit calculates a pin-to-pin distance for the at least one compressible gas actuator to calculate the gas volume.

4. The potential energy storage system according to claim 1, wherein the position sensor is an encoder measuring a current angle between the machine element and a platform.

5. The potential energy storage system according to claim 1, wherein the electronic control unit performs an adjustment of the hydraulic adjustment valve to add hydraulic fluid to the accumulator or remove hydraulic fluid from the accumulator in 3-second increments.

6. The potential energy storage system according to claim 5, wherein the electronic control unit disables the adjustment of the hydraulic adjustment valve for 5-minutes following the adjustment.

7. The potential energy storage system according to claim 1, further comprising a tail end pressure sensor and a rod end pressure sensor measuring a tail pressure and a rod pressure respectively from the at least one hydraulic cylinder.

8. The potential energy storage system according to claim 7, wherein the electronic control unit executes instructions to: receive an average target pressure; calculate an average tail pressure when the at least one hydraulic cylinder is extending; and calculate an average rod pressure when the at least one hydraulic cylinder is retracting.

9. The potential energy storage system according to claim 8, wherein the electronic control unit executes instructions to: compare the average tail pressure to the average target pressure; compare the average rod pressure to the average target pressure; and determine when the maximum target gas pressure should increase, decrease, or be constant.

10. The potential energy storage system according to claim 8, wherein the average tail pressure and the average rod pressure are calculated over a period of 5 minutes.

11. A computer-implemented method for storing potential energy for a material handler, the method comprises:

actuating a machine element using at least one hydraulic cylinder;

measuring a position of the machine element;

controlling the at least one hydraulic cylinder with a hydraulic circuit by an electronic control unit;

determining a maximum target pressure for at least one gas actuator coupled to the machine element;

calculating a target pressure for the at least one gas actuator at the position;

measuring a gas pressure measurement from the at least one gas actuator;

comparing the target pressure to the gas pressure measurement; and adjusting a hydraulic adjustment valve to increase or decrease an amount of hydraulic fluid within a hydraulic chamber of an accumulator thereby changing a gas pressure within the at least one gas actuator to correspond to the target pressure.

12. The computer-implemented method according to claim 11, further comprises: calculating a gas volume in the at least one compressible gas actuator at the position; and calculating the target pressure based on the gas volume and the maximum target pressure.

13. The computer-implemented method according to claim 12, further comprises: calculating a pin-to-pin distance for the at least one compressible gas actuator to calculate the gas volume.

14. The computer-implemented method according to claim 11, wherein the position sensor is an encoder measuring a current angle between the machine element and a platform.

15. The computer-implemented method according to claim 11, further comprises: adding the amount of hydraulic fluid to the accumulator or removing the amount of hydraulic fluid from the accumulator in 3-second increments.

16. The computer-implemented method according to claim 15, further comprises: waiting for 5-minutes following the adjusting step.

17. The computer-implemented method according to claim 11, further comprises: measuring a tail pressure with a tail end pressure sensor from the at least one hydraulic cylinder; and measuring a rod pressure from a rod end pressure sensor from the at least one hydraulic cylinder.

18. The computer-implemented method according to claim 17, further comprises: receiving an average target pressure; calculating an average tail pressure when the at least one hydraulic cylinder is extending; and calculating an average rod pressure when the at least one hydraulic cylinder is retracting.

19. The computer-implemented method according to claim 18, further comprises: comparing the average tail pressure to the average target pressure; comparing the average rod pressure to the average target pressure; and determining when the maximum target gas pressure should increase, decrease, or be constant.

20. The computer-implemented method according to claim 18, further comprises: calculating the average tail pressure and the average rod pressure over a period of 5 minutes.

* * * * *